US006037110A

United States Patent [19]

Green et al.

[11] Patent Number: 6,037,110

[45] Date of Patent: Mar. 14, 2000

[54] METHOD OF PROCESSING A SILVER HALIDE PHOTOGRAPHIC ELEMENT

[75] Inventors: Jeffrey K. Green, Harrow; Zoë Orr, Watford, both of United Kingdom

[73] Assignee: Eastman Kodak Company, Rochester, N.Y.

[21] Appl. No.: 09/061,507

[22] Filed: Apr. 17, 1998

[30] Foreign Application Priority Data

Apr. 18, 1997 [GB] United Kingdom ..... 9707859

[51] Int. Cl.[7] ..... G03C 5/395

[52] U.S. Cl. ..... 430/398; 430/463; 430/943

[58] Field of Search ..... 430/398, 400, 430/428, 429, 943, 463

[56] References Cited

FOREIGN PATENT DOCUMENTS 2 268 281 11/1975 France .

63-044 654 2/1988 Japan .

02 244 139 9/1990 Japan .

5-088 305 4/1993 Japan .

OTHER PUBLICATIONS

GF Nadeau et al "Process for Stabilizing Photographic Silver Images Against Oxidative Degradation" Research Disclosure vol. 233, No. 38, Sep. 1983 (Enclosed p. 299 XP002068446).

*Primary Examiner*—Hoa Van Le

*Attorney, Agent, or Firm*—J. Lanny Tucker

[57] ABSTRACT

A method for processing a silver halide photographic material comprises the steps of developing, fixing and washing the photographic material. The fixing step is carried out using a fixing solution comprising thiosulfate ions, and the washing step is carried out by washing the material with an aqueous solution containing an oxidizing agent capable of reacting with thiosulfate. The oxidizing agent is present in an amount sufficient to precipitate any silver in the solution.

9 Claims, No Drawings

METHOD OF PROCESSING A SILVER HALIDE PHOTOGRAPHIC ELEMENT

FIELD OF THE INVENTION

The invention relates to a method of processing a silver halide photographic material which method comprises the steps of developing, fixing and washing the material.

BACKGROUND OF THE INVENTION

The processing of a black-and-white photographic material usually comprises the steps of developing, fixing and washing the material. The processing of a color photographic material usually comprises the steps of color developing, bleaching, fixing and washing the material. The fixing step allows the removal of silver ions in the developed photographic material by formation of a soluble complex with the fixing agent. The fixing agent generally comprises a thiosulfate, e.g., sodium thiosulfate or ammonium thiosulfate. The soluble complex of silver and thiosulfate is removed from the material by washing.

Replenishment of the wash tank in a photographic material processor, e.g., a graphics art film processor in a similar way and in similar amounts to the replenishment of the developer and fixer tank, can lead to a substantial reduction in the amount of water consumed during processing. However, simply replenishing with water means that the concentrations of silver, thiosulfate and other by-products within the wash tank build up.

Conventionally, impurities are flushed through the tank and down the drain by the volume of liquid that flows through the wash tank. In moving to a system which uses wash water in the same way as developer and fixer, the volume of solution passing through the tank may be reduced to as little as one hundredth as that passing through a standard system. Consequently, the silver concentration eventually reaches a level at which the image permanence of the photographic material may be compromised.

JP-5088305 describes a method of processing a silver halide black-and-white photographic material in which washing is effected by supplying 0.8 to 3.0 $l/m^2$ of an aqueous hydrogen peroxide solution (0.3 to 2.0 g/l) along the direction of film transport and draining the waste water. The quantities of hydrogen peroxide employed provide sterilization and reduce the appearance of sludge or scum.

The present invention solves the problem of how to reduce the concentration of silver and thiosulfate in the wash solution, and to avoid impairment of the image.

SUMMARY OF THE INVENTION

The invention provides a method for processing a silver halide photographic material which comprises the steps of developing, fixing and washing the photographic material wherein the fixing step is carried out with a fixing solution comprising thiosulfate ions, and characterized in that the washing step is carried out by washing the material with an aqueous washing solution comprising an oxidizing agent capable of reacting with thiosulfate ions, the oxidizing agent being present in an amount sufficient to precipitate any silver in the washing solution.

Using this invention, the silver concentration in the wash solution is kept low so that image permanence is not affected. Thiosulfate ions are destroyed, ensuring that image stability is not degraded.

Using the appropriate concentration of oxidizing agent in the washing solution ensures removal of virtually all the silver from the solution.

The oxidizing agent contained in each aliquot of replenisher reacts almost immediately, upon entering the washing solution, ensuring that it is not able to attack the image on the photographic material.

The volume of washing solution may be substantially reduced without adversely affecting the sensitometry of the processed material. This in turn allows either greatly reduced volumes discharged to the drain or makes practical the collection of waste wash water for treatment in an appropriate plant.

A low level of free silver ion which may be left in solution may act as an effective biocide.

DETAILED DESCRIPTION OF THE INVENTION

By adding an appropriate amount of oxidizing agent to the washing solution, the thiosulfate ions can be destroyed, thus precipitating the silver and keeping the silver ion concentration in the washing solution at a very low level. Preferably, insufficient oxidizing agent is added to permit a significant residual level of oxidizing agent in the washing solution.

Preferably, the washing step is carried out by washing the material with an aqueous washing solution which is replenished by adding an aqueous solution of the oxidizing agent.

Preferably, the washing solution is filtered after use to remove precipitated solids. The filtered washing solution may be recycled for further use.

The oxidizing agent is capable of oxidizing thiosulfate ions to sulfate ions. Thus a colorless and soluble oxidation product is formed together with insoluble material comprising silver which is precipitated from solution.

The oxidizing agent may be selected from peroxides, perborates and persulfates. Preferably, the oxidizing agent has a low molecular size to facilitate its diffusion into the photographic material. In a particularly preferred embodiment of the invention hydrogen peroxide is used.

The oxidizing agent may be added to the wash solution in an amount to treat the thiosulfate carried in by the processed photographic material processed.

The oxidizing agent is present (or added to) the washing solution in an amount to provide from about 0.3 mmol to about 2 mol, preferably from about 2 mmol to about 0.5 mol, per $m^2$ of photographic material processed.

For example, from about 10 to about 500 ml of 0.1 to 12% hydrogen peroxide (or molar equivalent of another oxidizing agent) may be used, and preferably from about 75 to about 125 ml of 1 to 5% hydrogen peroxide.

The exact amount of oxidizing agent does not appear to correlate closely with the amount of thiosulfate destroyed. It is presumed that additional oxidation is performed by $Ag^+$ and aerial routes.

In order to improve the efficiency of washing, a variety of materials, e.g., halide salts or surfactants may be added to the washing solution. In a preferred embodiment, halide ions may be used at a concentration up to 20 g/l, and preferably from about 1 to about 10 g/l, of the solution. Suitable halide salts include alkali metal halides, e.g., potassium chloride.

Preferably, the wash replenishment solution further comprises a stabilizer for the oxidizing agent. e.g.. 1 g/liter 1-hydroxyethylene(1,1 diphosphoric acid) and 2 ml/liter diethylene triamine pentaacetic acid solution.

In addition to the steps of developing, fixing and washing, the method of the invention may comprise if necessary a bleaching step and/or reversal step. The development step may involve development in a black-and-white developer for a black-and-white photographic material or development in a color developer for a color photographic material.

Black-and-white developers are well known and include a silver halide reducing agent such as an aminophenol, a polyhydroxybenzene, e.g., hydroquinone and its derivatives, a 3-pyrazolidone, a pyrogallol, pyrocatechol and ascorbic acid.

Color developers comprise compositions which, in their oxidized form, react with a color coupler to form an image dye, the coupler being present either in the developer or in the photographic material. Color developing agents include paraphenylenediamines, e.g., diethyl-p-phenylenediamine and ethylhydroxyethyl-p-phenylenediamine.

The method of the invention can be employed in processing any kind of photographic material wherein a fixing treatment with thiosulfate may be useful. Such materials include negative-working materials, positive-working materials, black-and-white materials such as graphic arts and radiographic materials, color materials and reversal materials.

In a preferred embodiment of the invention the photographic material is a black-and-white photographic material. The silver coverage may be from about 0.4 to about 5 g/m$^2$.

The photographic materials may comprise a support coated on at least one surface with one or more silver halide emulsion layers. Such photographic materials are described in *Research Disclosure,* September 1994, 368, No. 36544, (hereinafter referred to as *Research Disclosure*).

Silver halide emulsions comprise grains of silver halide in a hydrophilic binder, e.g., gelatin. Different methods of preparing such emulsions have been described in *Research Disclosure,* section I-C. The gelatin may be replaced at least partially with other synthetic or naturally occurring hydrophilic colloids, e.g., casein, albumin, zein, polyvinyl alcohol and a cellulose derivative such as carboxymethylcellulose.

*Research Disclosure,* sections I-A and I-B describe the morphologies and composition of silver halide grains. The silver halide grains may comprise chloride, bromide, chlorobromide, bromochloride, chloroiodide, bromoiodide or bromochloroiodide. In a preferred embodiment of the invention, the photographic material being processed comprises one or more silver halide emulsion layers in which the silver halide is predominantly silver chloride.

The silver halide grains may be chemically sensitized as described in *Research Disclosure,* section IV.

The silver halide grains may be spectrally sensitized as described in *Research Disclosure,* section V.

In addition to the constituents mentioned above, the photographic material may contain other photographically useful constituents such as coating aids, stabilizers, plasticizers, antifoggants, antistatic agents and matting agents. Examples of such constituents are described in *Research Disclosure,* sections VI, VII, VIII and X.

Suitable supports which may be employed are described in section XV of *Research Disclosure.* The supports are generally polymeric supports produced from such polymers as cellulosic polymers, polystyrenes, polyamides, polyvinyl polymers, polyethylenes and polyesters. Alternatively, paper or metallic supports may be employed.

The photographic material may comprise other layers such as protective overcoats, intermediate layers, antihalation layers, and antistatic layers. These different layers and their arrangements are described in *Research Disclosure,* section II.

The invention is further illustrated by way of example as follows.

EXAMPLE

A typical graphic arts photoprocessing machine was used to process a black-and-white graphic arts film containing 3 g/m$^2$ silver.

The developer tank contained a graphic arts developer, KODAK™ RA2000 which was replenished in accordance with the instructions issued with the developer. The fixer tank contained an ammonium thiosulfate fix with an acetate buffer. This was replenished at 100 ml/m$^2$. It was filtered by an active carbon filter.

At the beginning, the wash tank contained only demineralized water. The wash water was replenished at 115 ml/m$^2$ using a replenishment washing solution having the following formulation.

For 1 liter of washing solution:

| | |
|---|---|
| Demineralized water | 900 g |
| Hydrogen peroxide (30% solution) | 96.7 g |
| Potassium chloride | 10 g |

The solution in the tank was filtered continuously, first through a 20 $\mu$m string filter and then through an activated carbon filter. The volume of wash solution contained in the wash tank and filters was approximately 10 liters.

After processing 75 m$^2$ of film, the silver concentration in the tank was less than 0.7 mg/l and the ammonium thiosulfate concentration was 1.3 g/l. The level of hydrogen peroxide in the wash tank was too low to be detected.

The invention has been described in detail with particular reference to certain preferred embodiments thereof, but it will be understood that variations and modifications can be effected within the spirit and scope of the invention.

We claim:

1. A method for processing a silver halide photographic material which comprises the steps of developing, fixing and washing the photographic material wherein the fixing step is carried out with a fixing solution comprising thiosulfate ions and characterised in that the washing step is carried out by washing the material with an aqueous solution which is replenished by adding an aqueous solution of an oxidising agent capable of reacting with thiosulfate, the oxidising agent being added in an amount from 2 mmol to 0.5 mol per m$^2$ of the photographic material processed sufficient to precipitate the silver in the solution.

2. The method of claim 1 wherein said oxidizing agent is a peroxide, perborate or persulfate.

3. The method of claim 2 wherein said oxidizing agent is hydrogen peroxide.

4. The method of claim 1 wherein said washing solution further comprises up to 20 g/l of a halide salt.

5. The method of claim 4 wherein said washing solution further comprises from about 1 to about 10 g/l of a halide salt.

6. The method of claim 5 wherein said halide salt is an alkali metal halide.

7. The method of claim 1 wherein said aqueous washing solution further comprises a stabilizer for said oxidizing agent.

8. The method of claim 1 wherein said silver halide photographic material is a black-and-white photographic material.

9. The method of claim 1 wherein said aqueous washing solution is filtered after use to remove precipitated solids.

* * * * *